US009803411B2

(12) United States Patent
Grabher

(10) Patent No.: US 9,803,411 B2
(45) Date of Patent: Oct. 31, 2017

(54) DEVICE FOR MOVING A MOVABLE FURNITURE PART IN AN OPENING DIRECTION IN RELATION TO A BASIC FURNITURE STRUCTURE OF AN ITEM OF FURNITURE

(71) Applicant: Grass GmbH, Hoechst (AT)

(72) Inventor: Guenter Grabher, Fussach (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/237,973

(22) Filed: Aug. 16, 2016

(65) Prior Publication Data

US 2017/0049230 A1 Feb. 23, 2017

(30) Foreign Application Priority Data

Aug. 21, 2015 (DE) ..... 20 2015 104 430 U

(51) Int. Cl.
*A47B 88/04* (2006.01)
*E05F 15/00* (2015.01)
(Continued)

(52) U.S. Cl.
CPC ..... *E05F 15/00* (2013.01); *A47B 88/0477* (2013.01); *A47B 88/463* (2017.01);
(Continued)

(58) Field of Classification Search
CPC ..... A47B 88/453; A47B 88/46; A47B 88/463; A47B 88/467; A47B 88/47
See application file for complete search history.

(56) References Cited

U.S. PATENT DOCUMENTS

2011/0080080 A1 4/2011 Zimmer et al.
2011/0210653 A1* 9/2011 Salice ..... A47B 88/47 312/319.1
(Continued)

FOREIGN PATENT DOCUMENTS

DE 10 2008 021 458 A1 1/2010
DE 20 2010 009 794 U1 11/2011
(Continued)

OTHER PUBLICATIONS

Extended European Search Report (Application No. 16183503.8) dated Jan. 12, 2017.
German Search Report (Application No. 20 2015 104 430.5) dated May 10, 2016.

*Primary Examiner* — Daniel Rohrhoff
(74) *Attorney, Agent, or Firm* — Burr & Brown, PLLC

(57) ABSTRACT

A device for moving a movable furniture part, the device including a force accumulator such that when the device is fitted to an item of furniture, the movable furniture part in the case of an opening procedure by action of the force accumulator is capable of being put in an opening position by way of an ejector. A coupling installation is included, which in the case of a charging procedure of the force accumulator is effective between the ejector and the force accumulator. The ejector is designed in such a manner that the latter in the region of the end of the path thereof in the case of the opening procedure couples to the coupling installation. For a following closing procedure of the movable furniture part and a charging procedure of the force accumulator associated therewith, the coupling between the ejector and the force accumulator is in a clearance-free manner.

10 Claims, 9 Drawing Sheets

(51) Int. Cl.

| | |
|---|---|
| ***E05F 1/16*** | (2006.01) |
| ***A47B 88/463*** | (2017.01) |
| *E05F 5/00* | (2017.01) |

(52) U.S. Cl.

CPC ..... *E05F 1/16* (2013.01); *E05F 5/003* (2013.01); *E05Y 2201/426* (2013.01); *E05Y 2201/624* (2013.01); *E05Y 2600/12* (2013.01); *E05Y 2900/20* (2013.01)

(56) References Cited

U.S. PATENT DOCUMENTS

| | | | | |
|---|---|---|---|---|
| 2014/0021841 | A1* | 1/2014 | Brunnmayr ..... | A47B 88/0477<br>312/319.1 |
| 2014/0363107 | A1* | 12/2014 | Egger ..... | F16C 29/02<br>384/21 |
| 2015/0091424 | A1* | 4/2015 | Nuckolls ..... | A47B 88/463<br>312/319.1 |
| 2015/0374123 | A1 | 12/2015 | Goetz et al. | |
| 2016/0270533 | A1* | 9/2016 | Dubach ..... | A47B 88/0481 |

FOREIGN PATENT DOCUMENTS

| | | | |
|---|---|---|---|
| DE | 20 2010 009 797 | U1 | 11/2011 |
| DE | 10 2011 122 266 | A1 | 6/2013 |
| DE | 20 2012 003 537 | U1 | 7/2013 |
| WO | 2014/165873 | A1 | 10/2014 |

* cited by examiner

DEVICE FOR MOVING A MOVABLE FURNITURE PART IN AN OPENING DIRECTION IN RELATION TO A BASIC FURNITURE STRUCTURE OF AN ITEM OF FURNITURE

This application claims the benefit under 35 USC §119 (a)-(d) of German Application No. 20 2015 104 430.5 filed Aug. 21, 2015, the entirety of which is incorporated herein by reference.

FIELD OF THE INVENTION

The present invention relates to a device for moving a movable furniture part in an opening direction in relation to a basic furniture structure of an item of furniture, and an item of furniture having such a device.

BACKGROUND OF THE INVENTION

In the case of furniture parts such as, for example, drawers, furniture doors, or furniture flaps which are movably received on a basic furniture structure of an item of furniture, guide units, hinges, and fittings are employed for influencing the movement of the respective furniture part.

An additional function for influencing the movement of the furniture part is provided in some embodiments by the respective device. This relates, for example, to systems with an opening function of the furniture part by way of a force accumulator which is discharged during the opening.

SUMMARY OF THE INVENTION

The present invention is based on the object of providing a device of the type referred to at the outset which has an improved charging function.

The present invention proceeds from a device for moving a movable furniture part in an opening direction in relation to a basic furniture structure of an item of furniture, wherein the movable furniture part by way of guide means is capable of being put in the opening direction and into a closing direction that is counter to the opening direction. The device has a force accumulator, such that by way of the device which is fitted to the item of furniture the movable furniture part in the case of an opening procedure by action of the force accumulator is capable of being put in an opening position by way of an ejector.

Preferably, the movable furniture part is configured as a drawer or a flap, and the drawer or flap is movably guided on the basic furniture structure by way of guide means, for example, pull-out rails or hinges.

Advantageously, the device is disposed on the movable furniture part, in particular, on a lower side of a drawer base. However, the device may also be configured on guide means of the movable furniture part, in particular, positionally fixed to the basic furniture structure and/or on the basic furniture structure.

The ejector of the device advantageously interacts with an entrainment element of the item of furniture and/or of the guide means of the furniture part and/or of the basic furniture structure in the case of an opening or closing procedure, respectively.

If and when the device is disposed on the movable furniture part, the entrainment element is favorably configured on the guide means of the item of furniture and/or on the basic furniture structure, advantageously so as to be positionally fixed in relation to the basic furniture structure.

If and when the device is disposed on the guide means of the movable furniture part and/or on the basic furniture structure so as to be positionally fixed in relation to the basic furniture structure, the entrainment element is preferably configured on the movable furniture part.

The essential aspect of the present invention is now to be seen in that a coupling installation which in the case of a charging procedure of the force accumulator is effective between the ejector and the force accumulator is provided, wherein the ejector is designed in such a manner that the latter in the region of the end of the path thereof in the case of the opening procedure couples to the coupling installation, and that for a following closing procedure of the movable furniture part, and a charging procedure of the force accumulator associated therewith, the coupling between the ejector and the force accumulator is effective in a clearance-free manner by way of the coupling installation.

On account thereof, a noise which is disturbing to the user, for example, a clicking noise, is completely avoided or greatly reduced when the entrainment element impacts the ejector.

In one preferred variant of the present invention, the coupling installation in the case of an opening movement of the movable furniture part, in particular, during the discharging procedure of the force accumulator, is not operationally connected to the ejector.

Advantageously, the coupling installation, for example, a coupling member of the coupling installation, is movably disposed on the housing of the device, for example, on a base plate of the housing and/or on a cover component of the housing. In particular, a coupling member of the coupling installation is pivotably and/or rotatably disposed on the housing of the device.

The covering component may be provided for covering the base plate of the housing of the device across a substantial region, that is to say, by more than 50% of the area of the base plate of the housing.

For example, a coupling member is configured as a lever, in particular, a rigid lever.

The coupling installation may be composed of metal, for example, steel, and/or of a sheet-metal, plastics, wood, or a combination of these materials.

It is furthermore proposed that a movable control member is provided on the ejector in such a manner that the ejector, for a charging procedure of the force accumulator, is capable of being operationally connected to the coupling installation when the movable furniture part assumes a position which is predefined in relation to the ejector.

For example, the ejector is capable of being operationally connected to the coupling installation when the movable furniture part in the case of the opening procedure departs from the ejector.

The movable control member may be configured as a latch element having a hooked portion.

Advantageously, the movable control member is disposed on the ejector in such a manner that the former interacts with an entrainment element, for example, of the movable furniture part or of the guide means of the furniture part and/or of the basic furniture structure, in such a manner that the ejector in the case of a movement of the movable furniture part in the opening direction is moved to a terminal position.

For example, the movable control member is configured on the ejector in such a manner that the movable control member may couple to the entrainment element of the movable furniture part and/or of the guide means of the furniture part and/or of the basic furniture structure exclusively in an opening movement of the movable furniture part.

Coupling of a coupling member of the coupling installation to the ejector takes place during a movement of the movable furniture part, in particular, during an opening movement, advantageously at the end of a discharging procedure of the force accumulator, for example, following completion of the discharging procedure. Coupling may take place in such a manner that the movable control member of the ejector during the opening movement of the movable furniture part is pivoted in the direction of the coupling member, so as to be in clearance-free contact with the coupling member.

It is also conceivable for the movable control member to be disposed on the force accumulator and/or on the coupling installation.

It also proves advantageous for the ejector to assume clearance-free coupling to the coupling installation when the ejector returns from the terminal position thereof to a standby position, in particular, during the opening procedure of the movable furniture part.

Advantageously, the standby position forms a starting position of the movement of the ejector in the case of the closing procedure of the movable furniture part in order for the force accumulator to be charged by way of the coupling installation.

For example, the ejector, in the reverse movement of the ejector in relation to the remaining device from the terminal position to the standby position of the ejector, by way of the movable control member couples in a clearance-free manner to the coupling installation, for example, to a coupling member of the coupling installation.

Moreover, it is advantageous for the ejector in the standby position to be under bias.

Advantageously, the ejector in the standby position is compressively charged.

Optionally, the coupling installation in the standby position is under bias; in particular, a coupling member is under a compressively-charged bias.

For example, the ejector is coupled to the coupling installation in such a manner that a compressive force is transmitted from the ejector to the coupling installation.

It is also of advantage for the device to comprise an elastic member, wherein the elastic member urges the ejector into the standby position thereof. In particular, the elastic member urges the ejector from the terminal position thereof into the standby position thereof.

Advantageously, the ejector at the terminal position thereof by way of a force of the elastic member is subjected to a reversal of movement.

The elastic member may act on the ejector in such a manner that the ejector in and/or during a movement of the movable furniture part in the opening direction, for example, in the opening procedure, by way of the elastic member is capable of being put from the terminal position of the ejector to a standby position.

The elastic member may be designed as a spring element, for example, a helical spring, a leaf spring, a leg spring, an elastic rubber element, or an elastic plastics element. It is also conceivable that the elastic member is assembled from a combination of the elements mentioned.

Advantageously, the elastic member acts in a damping and/or sprung manner.

Advantageously, the elastic member in the standby position presses on the ejector; in particular, the elastic member in the standby position of the ejector is under bias.

Moreover, it is favorable for the movable control member to be disposed on the ejector in such a manner that the former in the opening procedure of the movable furniture part separates from an entrainment element of the movable furniture part and/or of the guide means of the furniture part and/or of the basic furniture structure, such that the control member is no longer in contact with the entrainment element, for example, when the elastic member has reached a maximum force charge, for example, a spring tension, in particular, when the ejector has reached the terminal position thereof. On account thereof, any coupling of the ejector to the entrainment element of the movable furniture part and/or of the guide means of the furniture part and/or of the basic furniture structure is released.

Advantageously, the elastic member is disposed on the housing of the device, for example, on the base plate of the housing and/or on a cover component of the housing, in particular, on a side wall of the housing.

Moreover, the elastic member may be configured on the ejector.

The elastic member may be charged by way of the opening movement of the movable furniture part, for example, by a compressive force of the ejector on the elastic member, advantageously by way of a movement of the ejector in the direction of the terminal position.

It is also conceivable for the elastic member to be configured separately from the device and from the ejector. For example, the device with the ejector may be disposed on the movable furniture part, and the elastic member may be disposed on the basic furniture structure or on the guide means of the furniture part.

The elastic member preferably has a spring force which is comparatively very minor. Advantageously, the elastic member absorbs a comparatively minor dynamic energy of the ejector and/or of the movable furniture part and/or of the entrainment element of the guide means of the furniture part or of the basic furniture structure, respectively.

On account thereof, an opening and/or closing movement of the movable furniture part may be designed so as to be comfortable for a user. Advantageously, the movement of the movable furniture part is performed without any abrupt variation in velocity; in particular, the opening movement of the movable furniture part is not varied by any action of the elastic member so as to be perceptible to a user.

It is also conceivable that the elastic member is configured on the force accumulator.

Preferably, the elastic member which is configured on the force accumulator acts on the ejector by way of the coupling installation which is operationally connected in a clearance-free manner to the ejector.

The elastic member may act between the housing of the device and the ejector of the device, and/or between the ejector and the coupling installation, and/or between the coupling installation and the force accumulator.

In one advantageous design embodiment of the present invention, the movable control member is pivotably, in particular, rotatably disposed on the ejector of the device.

It is also advantageous that the movable control member pivots away, advantageously rotates away from the entrainment element of the movable furniture part and/or of the guide means of the furniture part and/or of the basic furniture part, once a maximum discharge force of the elastic member has been reached. In particular, the elastic member in the terminal position of the ejector is charged with a maximum force.

For example, any coupling of the ejector to the entrainment element of the movable furniture part and/or of the guide means of the furniture part and/or of the basic furniture part is released latest when the terminal position of the ejector and/or the maximum discharge of force of the elastic member has been reached.

In one advantageous embodiment of the present invention, the pivoting and/or rotating movement of the movable control member is designed in such a manner that the coupling of the ejector to the entrainment element of the movable furniture part and/or of the guide means of the furniture part and/or of the basic furniture structure is released.

Moreover, it is of advantage that the movable control member is guided, in particular, so as to be pivotable in such a manner that the ejector of the device, in the case of a movement of the movable furniture part in the opening direction, is capable of being operationally connected in a clearance-free manner to the coupling installation.

For example, the pivoting and/or rotating movement of the movable control member acts in such a manner that the ejector and/or the movable control member of the ejector, by way of the pivoting and/or rotating movement, is/are capable of being put in contact with the coupling installation in such a manner that in the closing procedure a transmission of movement from the coupling installation to the force accumulator is possible in a clearance-free manner.

In one advantageous design embodiment of the device, a gate-type guide is configured on the housing of the device, in particular, on the base plate of the housing and/or on the ejector.

The movable control member and/or the ejector, by way of the gate-type guide, may be guided in such a manner that the ejector is capable of being brought into clearance-free contact with a coupling member of the coupling installation.

Advantageously, the movable control member and/or the ejector by means of the gate-type guide are/is guided in such a manner that the coupling of the ejector to the entrainment element is released once the terminal position of the ejector in the opening procedure of the movable furniture part has been reached.

In one further variant, an, in particular, clearance-free coupling of the ejector to a coupling member of the coupling installation is released during a movement of the movable furniture part in the closing direction, once the charging procedure of the force accumulator has been terminated.

Advantageously, the movable control member is configured in such a manner that the movable control member following a charging procedure of the force accumulator is moved and/or pivoted and/or rotated such that the coupling of the ejector to the coupling member of the coupling installation is released.

Moreover, it is favorable for the gate-type guide of the housing and/or of the ejector to be designed in such a manner that the movable control member following a charging procedure of the force accumulator is guided in such a manner that the coupling of the ejector to the coupling member of the coupling installation is released.

It is also of advantage for a coupling member of the coupling installation, by way of a first end, to be movably guided on a gate-type guide.

Moreover, it is conceivable that the gate-type guide is designed in such a manner that the coupling member by way of the first end thereof is guided on the gate-type guide parallel with a closing and/or opening direction of the movable furniture part.

Advantageously, a coupling member of the coupling installation by way of a first end may couple to the ejector.

It is moreover preferable for the coupling installation to not be connected to the force accumulator in a releasable and clearance-free manner.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
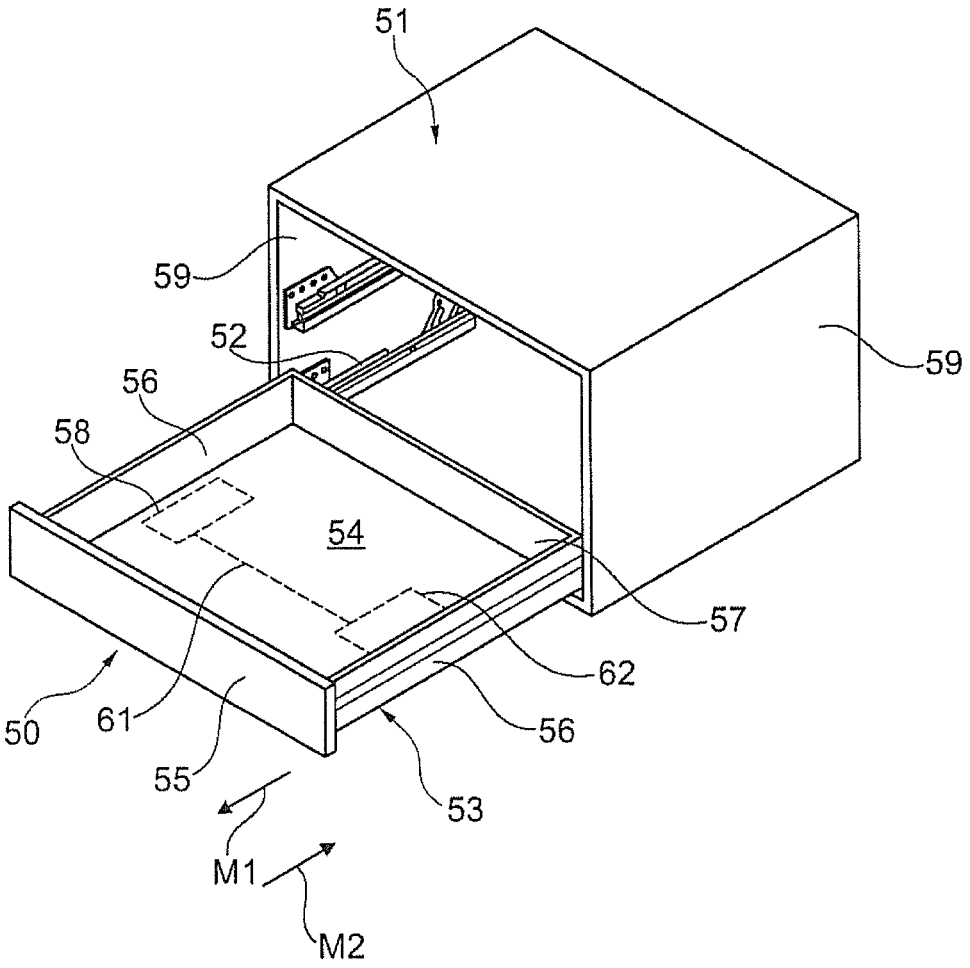
FIG. 1 shows an item of furniture according to the present invention in a perspective view from obliquely above, having a drawer in a completely opened state on a basic furniture structure.

An item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
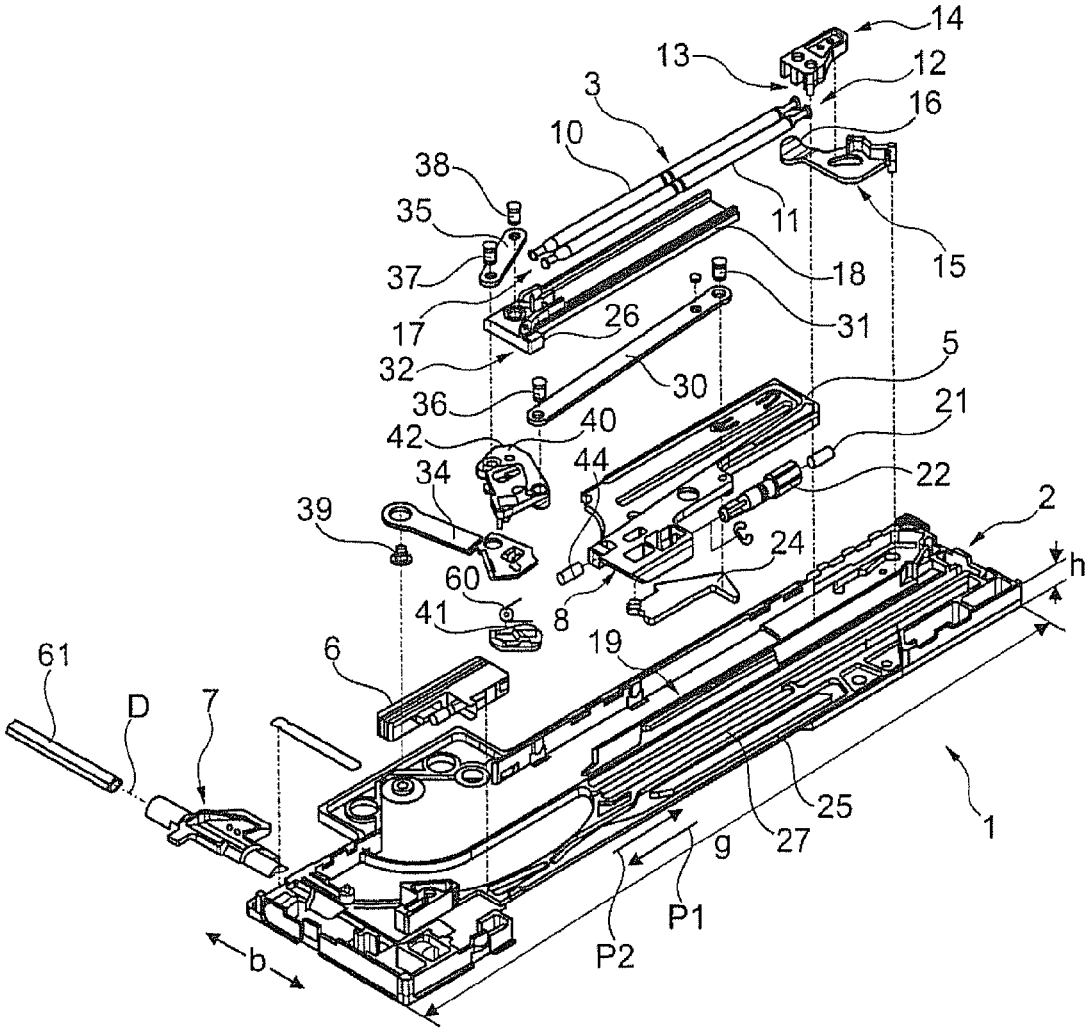
FIG. 2 shows a device according to the present invention, without a cover component, in a exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1.

The drawer 53 by way of the guide means 52, for example, two identical part-pullout units or full-pullout units, is mounted on the basic furniture structure 51 so as to be displaceable in the directions M1 and M2.

Alternatively, the ejector unit 1 may be disposed on the basic furniture structure 51 or on the guide means 52 of the item of furniture 50.

The ejector unit 1 comprises inter alia a base plate 2, a force accumulator 3, a coupling installation 4, an ejector 5, an activator 6, and a locking member 7.

Figure 9:
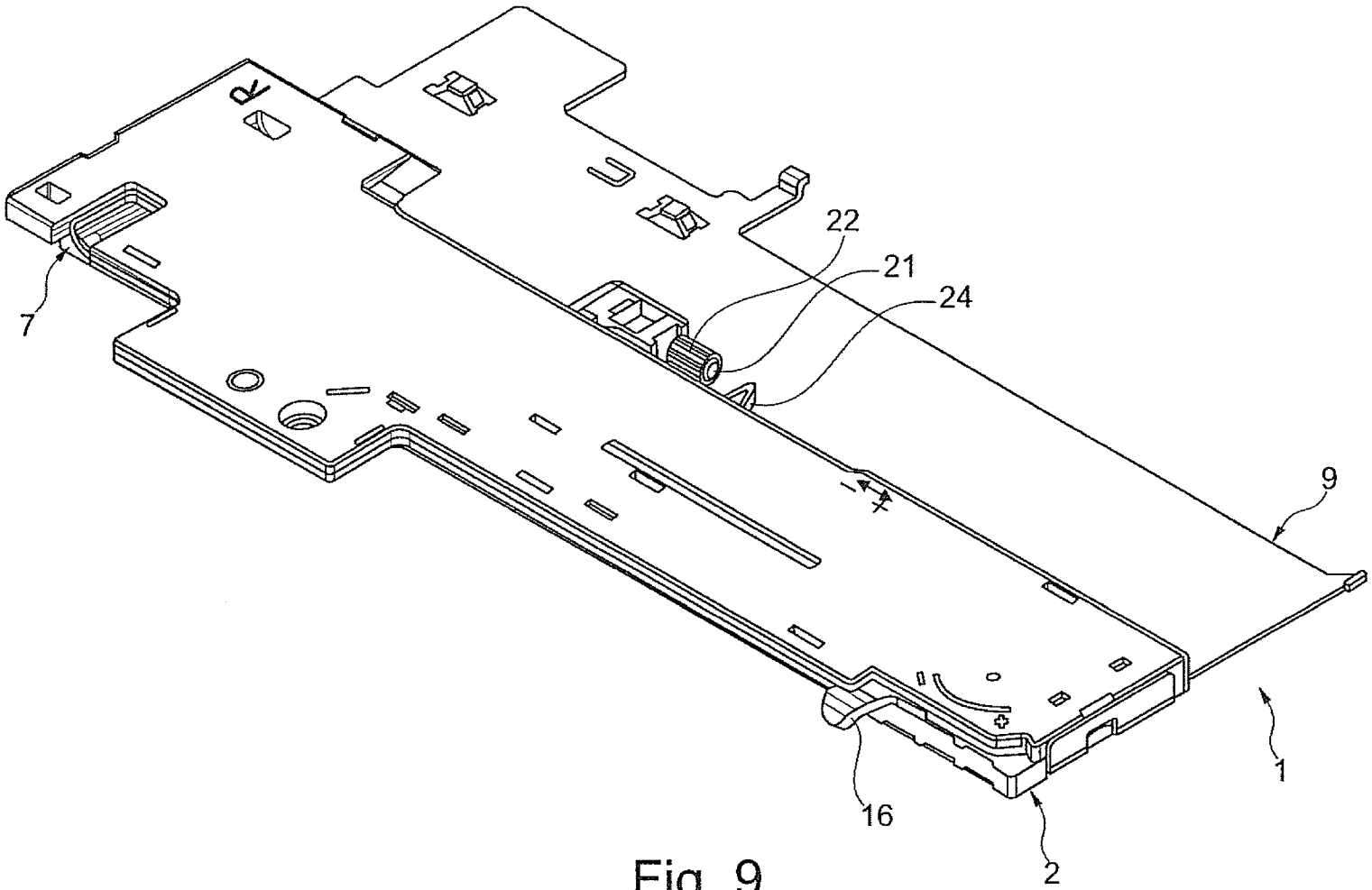
FIG. 9 shows the device according to FIG. 5, having the cover part, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on a drawer 53 may advantageously be pre-adjusted in the case of the opening procedure of the drawer 53.

The associated ends of the coil springs 10, 11 are fastened to a slide-type motion element 18 at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2 and 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1, and the closing direction of the drawer 53 corresponds to the direction P2.

Herebelow, an assembled state of the ejector unit 1 on the drawer base 54 is assumed.

Figure 3:
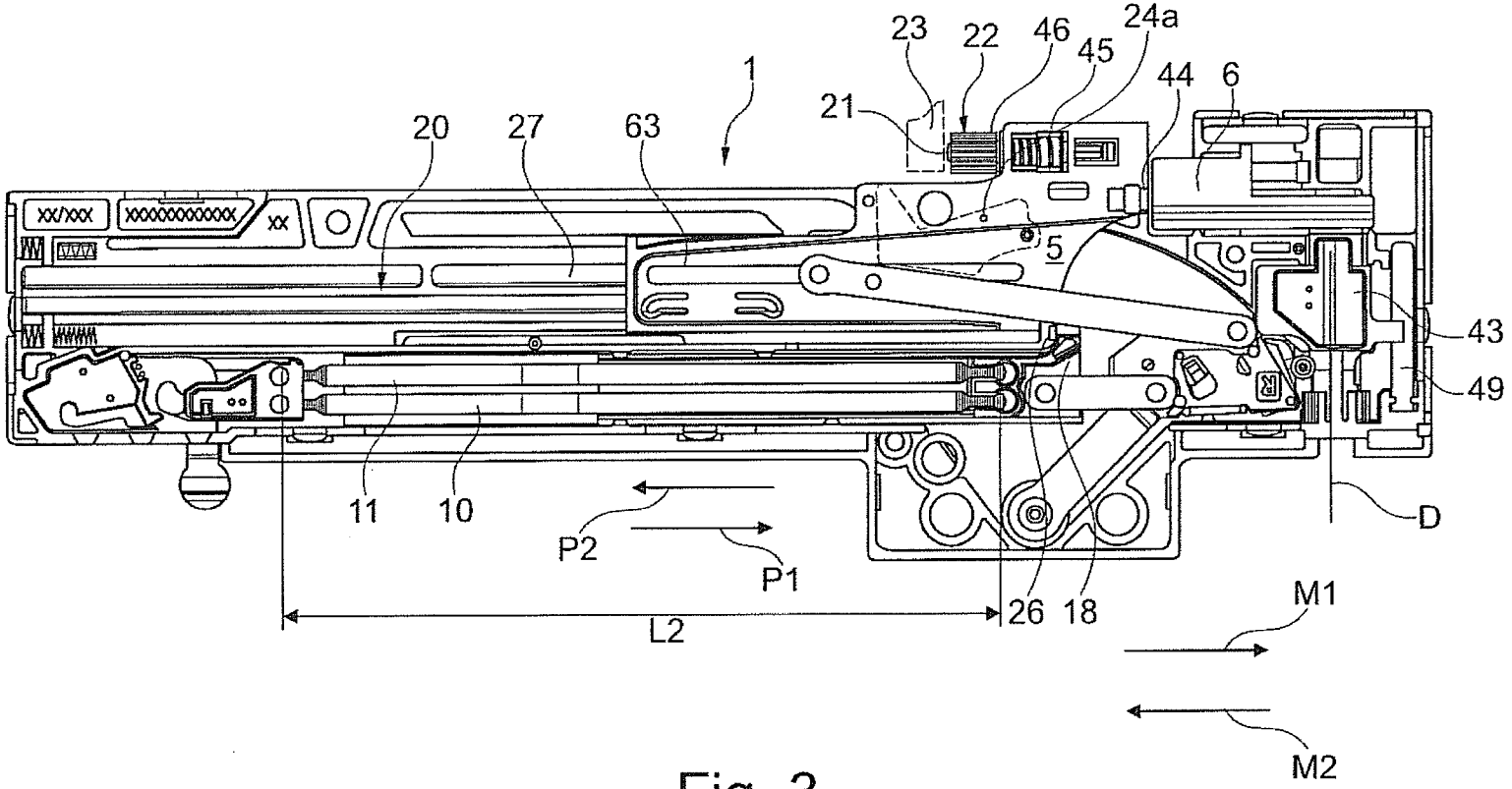
FIGS. 3 to 8 show the device according to FIG. 2, in an assembled state, in a plan view of a first main side, in various operational states.
Figure 7:
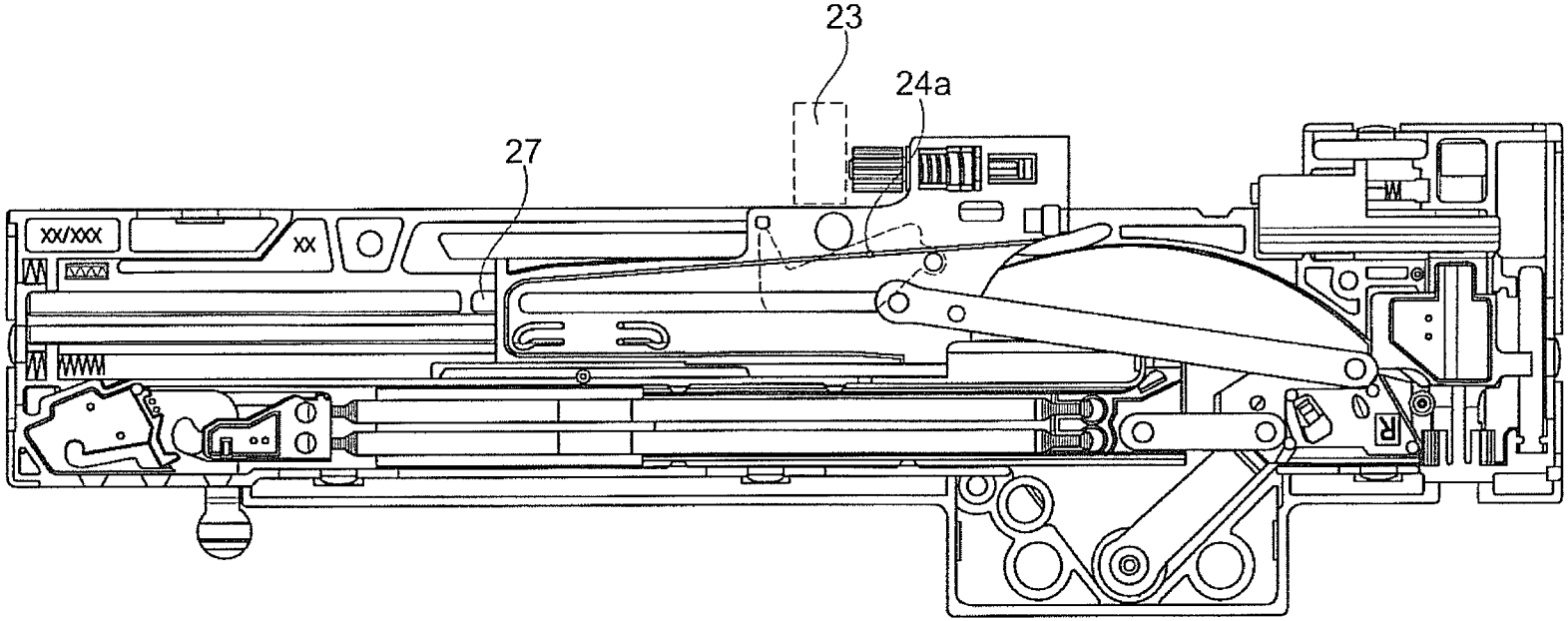
Figure 8:
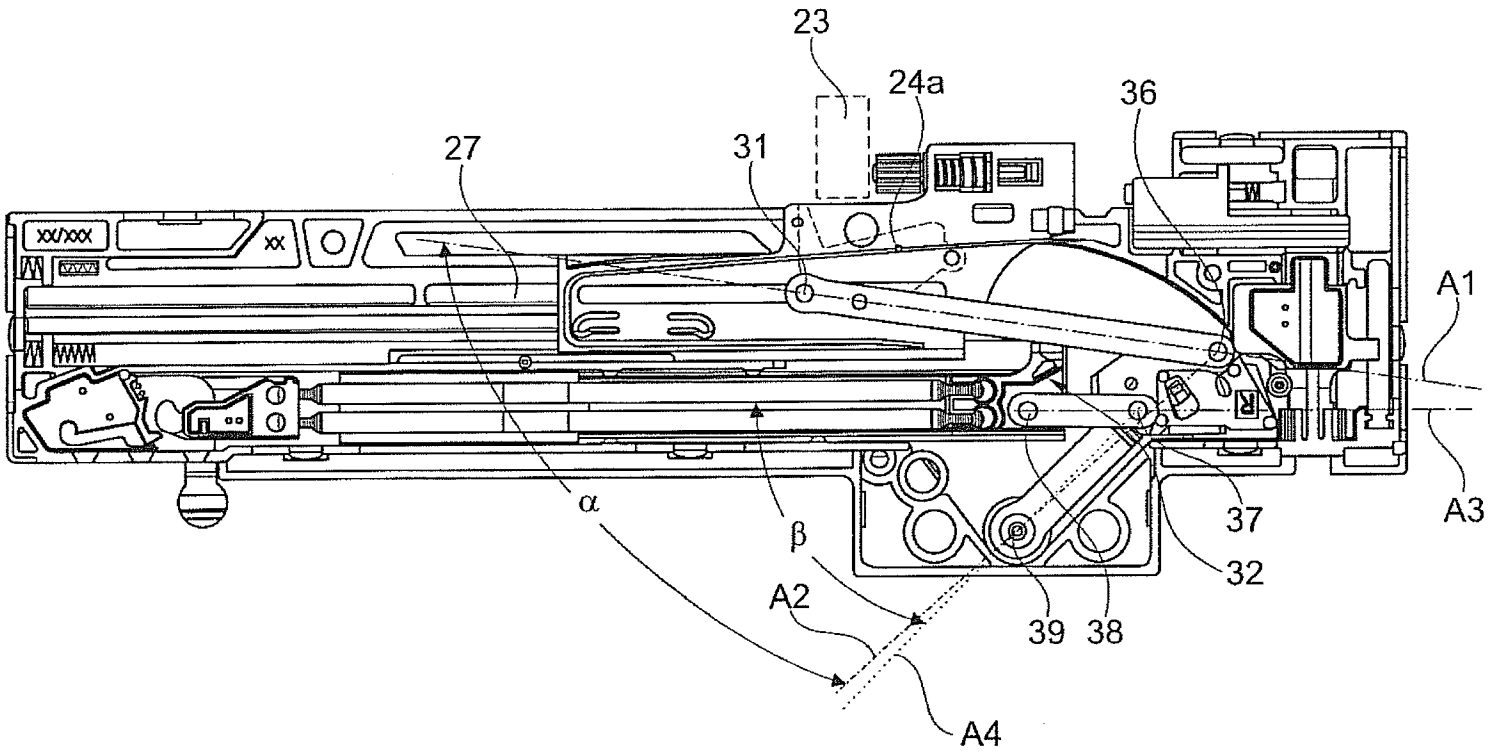

FIGS. 3, 7 and 8 show the ejector unit 1 in a tensioned state of the force accumulator 3, in which the coil springs 10, 11 are elongated or are tensioned so as to be under a tensile load, respectively; herein, the motion element 18 in relation to a retracted position in the direction P2 is offset on the base plate 2 in the direction P1 and is retained in a tensioned position.

Figure 5:
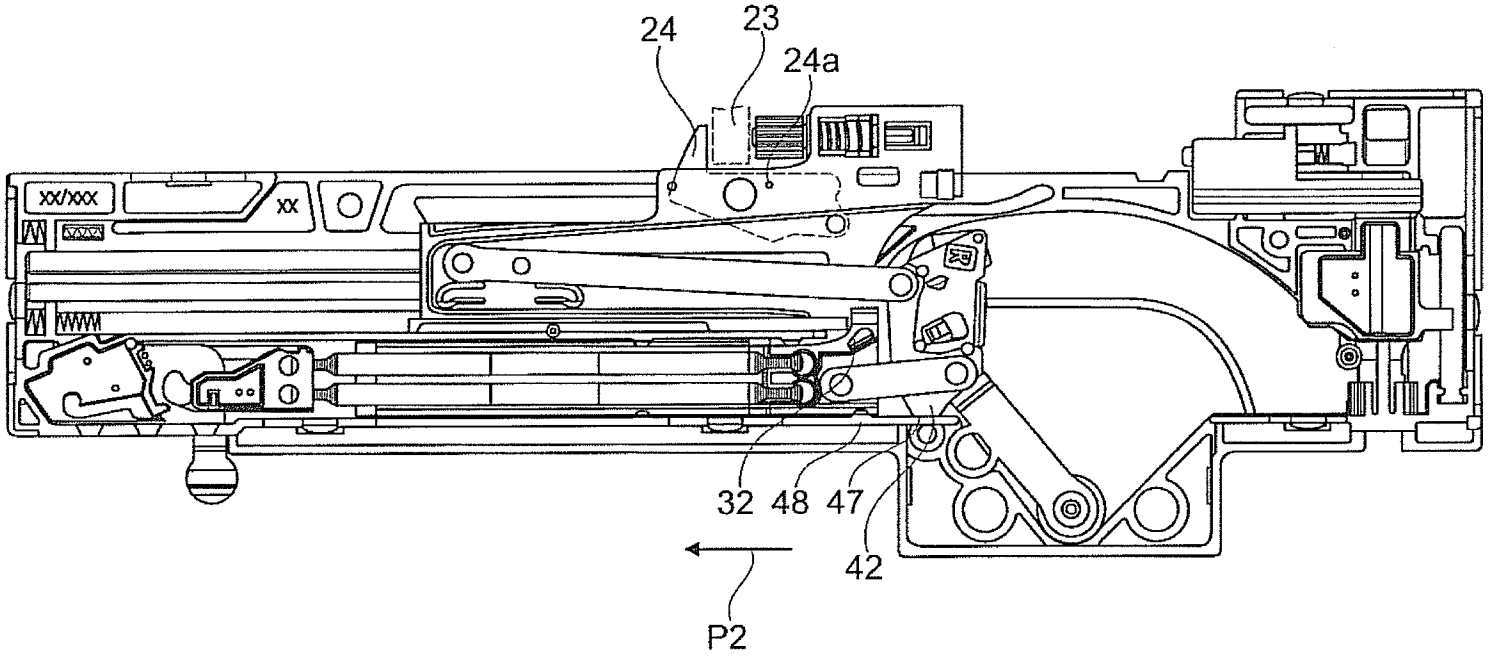
Figure 6:
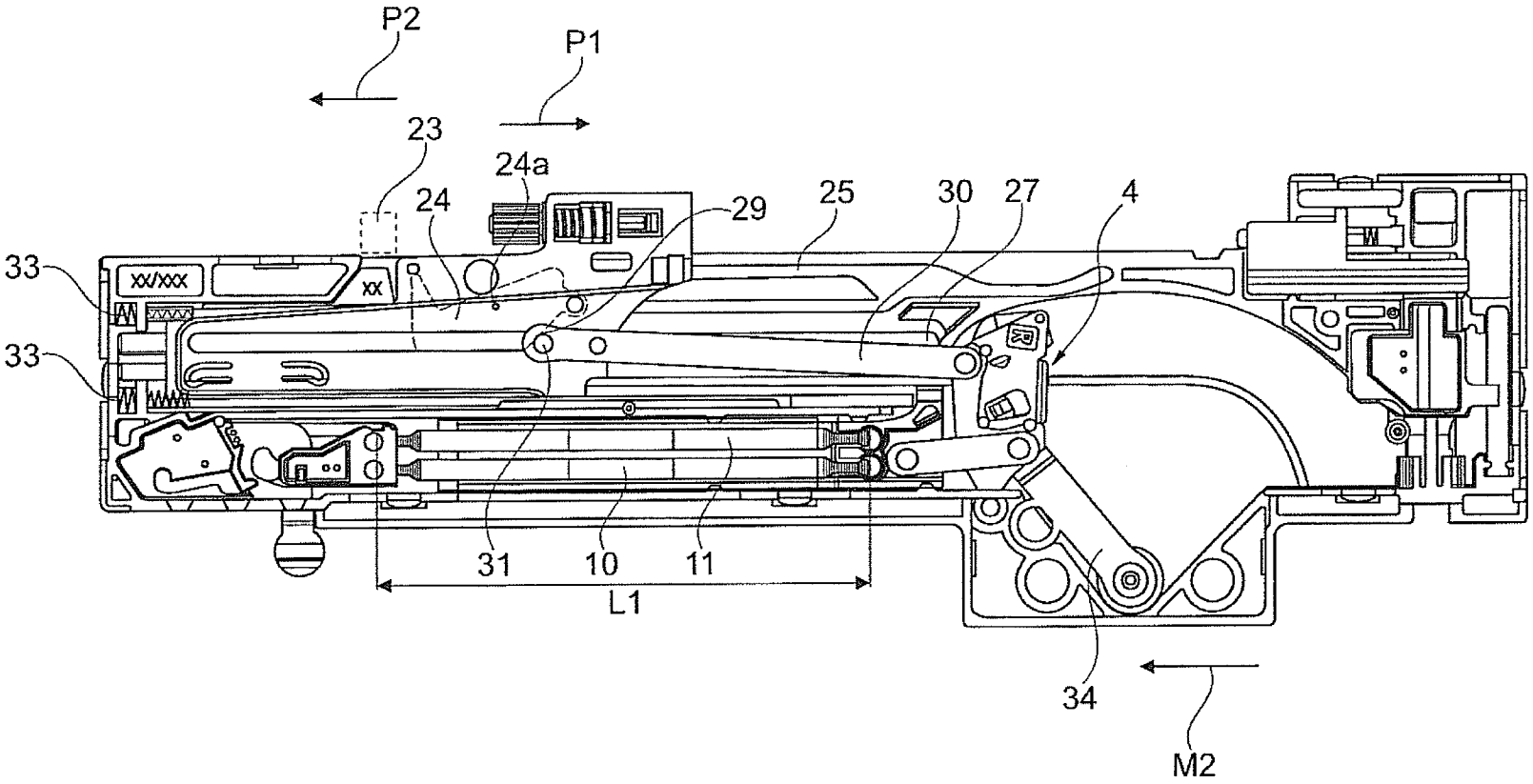

FIGS. 5 and 6 show the ejector unit 1 in a discharged basic state of the force accumulator 3, in which the coil springs 10, 11 are furthermore tensioned under a tensile load but to a lesser degree, having a length L1.

In the tensioned state of the force accumulator 3 the coil springs 10, 11 have a length L2 which is greater than L1.

A retaining member 32 having a stop element 26 is present on the motion element 18. The stop element 26 in the case of a force-assisted opening procedure is in contact with an ejector 5.

By way of the coupling installation 4, the force accumulator 3 or the motion element 18, respectively, is operationally connected to the ejector 5, preferably exclusively in the case of the closing procedure of the drawer 53. In particular, the ejector 5 is movable to and fro exclusively in a linear manner, or so as to be parallel with the movement direction of the motion element 18, respectively, in the directions P1 and P2. To this end, a linear guide 20 which is adapted to guide portions, for example, on one side of the ejector 5 is configured on the base plate 2.

Figure 4:
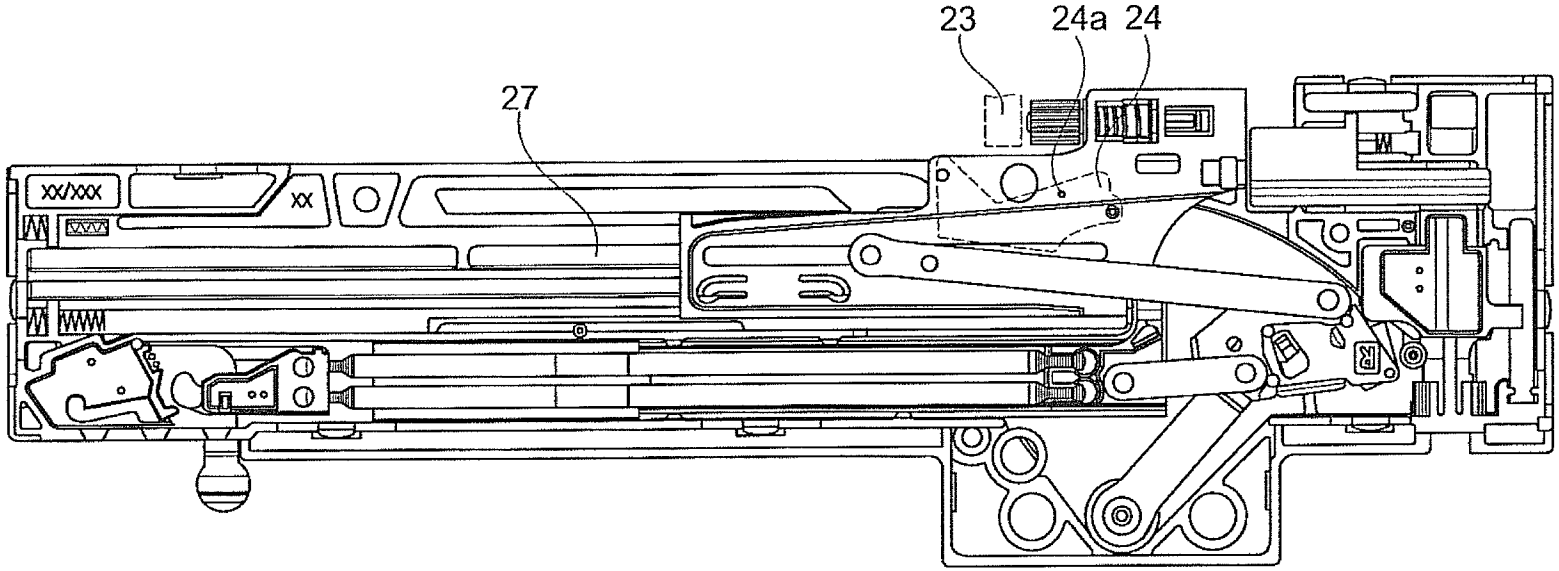

An opening procedure of the drawer 53, caused by the ejector unit 1, takes place exclusively by way of a direct operational connection of the force accumulator 3 to the ejector 5, by way of the motion element 18 which moves in the direction P2. To this end, a stop element 26 which is advantageously designed so as to be elastic and thus prevents or at least dampens any sound which is disturbing to the user when the motion element 18 impacts the ejector 5 in the opening procedure of the drawer 53 is configured on the motion element 18 (FIGS. 3, 4 and 5).

A front-gap adjustment assembly 8, which is configured on the ejector 5, comprises a housing 45 and a set screw 22 having a contact portion 21. The set screw 22 has an external thread which interacts with an internal thread on the housing 45. Depending on the rotation direction, a position of the contact portion 21 of the set screw 22 is adjustable in the direction P1 or P2 by manual rotation of an operating portion 46 of the set screw 22 by a user. In particular, the set screw 22 is configured so as to be self-locking in relation to the housing 45. A measure of a front gap between the drawer front 55 and the drawer 53, which is closed on the basic furniture structure 51, and end sides of the basic furniture structure 51 is capable of being predefined by way of the predefined position of the set screw 22.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the entrainment element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which the latch component 24 in relation to the external periphery of the base plate 2 is completely retracted, to an outwardly pivoted position in which the latch component 24 by way of a cam partially projects beyond the external periphery of the base plate 2 (FIG. 5), this being implemented by way of a loop-shaped closed guide track 25 in the base plate 2 and by way of a guide pin 24*a*, engaging is the guide track 25, on the latch part 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement and/or by the drawer 53 being manually moved farther in the opening direction M1 by a user, the ejector 5 is subsequently displaced in relation to the base plate 2 in the direction P2. This is possible because the latch component 24 which has been outwardly pivoted so as project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inwardly, this being predefined by the interaction between the guide track 25 and the guide pin 24*a* on the latch component 24 being engaged therein.

If and when the drawer 53 following a discharging procedure of the force accumulator 3 is moved farther in the opening direction M1, the ejector unit 1 separates from the entrainment element 24, cancelling contact between the entrainment element 23 and the contact portion 21 of the set screw 22 (FIG. 6).

From the terminal position described above, which the ejector assumes only briefly, the ejector 5 by spring elements 33 on the base plate 2 is urged by, for example, a few millimeters in the direction P1. In relation to the coil springs 10, 11 of the force accumulator 3, the spring elements 33 have a comparatively minor force. By way of the movement of the ejector 5 in the direction P1 by way of the force of the spring element 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is a starting position of the ejector 5 for a charging procedure of the force accumulator 3 by way of the coupling installation 4.

Besides, the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, the connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A1 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle 3.

The guide lever 34 of the coupling installation 4, on a second end, comprises a lever attachment 40. A locking element 41 and a stop element 42 are configured on the lever attachment 40.

The terminal position of the discharged state of the force accumulator 3 (FIG. 5) is predefined by a stop of the stop element 42 of the guide lever 34 on a wall portion 47 on a step-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator 3 by way of the motion element 18 is held free of clearance in the terminal position of the discharged state.

In particular, the stop element 42 and/or the wall portion 47 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared up ratio.

The gear ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, transmit the force which is exerted by the ejector 5 in a geared down ratio to the force accumulator 3. This means that a user when charging the force accumulator 3 has to apply less force to the ejector 5 than the user would have to apply when wishing to charge the force accumulator 3 without gearing down, or when directly pulling the end 17 of the force accumulator 3 in the direction P1, respectively.

The beginning and the end of the charging procedure of the force accumulator 3 or of the coil springs 10, 11, respectively, is visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In a tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior to an automatic retracting feature for the force-assisted retraction of the drawer 53 to the fully closed position on the basic furniture structure 51 becoming effective, for example. The automatic retracting feature is not part of the ejector unit 1, and is integrated, for example, in the guide means 52 or in the part-pullouts or full-pullouts, respectively.

After the force accumulator 3 has been tensioned, the ejector 5 by virtue of bearing on the entrainment element 23 is moved farther in direction P1 in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin 24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and is displaceable so far in the direction P1, in particular, by an automatic retracting feature, until the drawer 53 is fully closed on the basic furniture structure 51, and the ejector 5 bears on the activator 6 in the basic position according to FIG. 3.

In the basic position of the ejector unit 1 according to FIG. 3, it is possible for a user to pull the drawer 53 in the opening direction M1 without an ejector function or without first manually cancelling the locking state, respectively. Herein, the force accumulator 3 of the ejector unit 1 is non-actuated or charged, respectively.

In order for the drawer 53 by way of the ejector unit 1 to be expelled from the position in which the drawer 1 is completely retracted or closed, respectively, on the basic furniture structure 51, a user has to act on the drawer while pushing from the outside in the direction M2. To this end, the ejector unit 1 has a so-called touch-latch function which knows a locked state which is unlockable in that the retracted drawer 53 which is closed on the basic furniture structure 51 is moved in the closing direction M2. This closing movement, or inwardly pushing the drawer 53 in the direction M2, respectively, is performed until a stop position corresponding to a front gap which in the closed state of the drawer 53, is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for unlocking and thus the force-assisted ejection of the drawer 53 to be reliably predefined.

Proceeding from the basic position according to FIG. 3, the ejector unit 1 together with the drawer 53 is moved in the direction M2. Since the set screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. The flap 43 by the rotating movement is released from a locked position into which the flap 43 is urged by a spring member which is configured as a leaf spring 49. In the locked state of the ejector unit 1, the flap 43 which is located in the locking position blocks the guide lever 34 or the lever attachment 40, respectively, in such a manner that the force accumulator 3 remains in the charged state thereof.

Blocking of the guide lever 34 is cancelled by the rotating movement of the flap 43. The locking element 41 on the lever attachment 40, which is biased by a leg spring 60, hereby preferably pivots out.

The locking element 41, which projects from the lever attachment 40, moves conjointly with the pivoting procedure of the guide lever 34 below the flap 43, past the latter, and leads further without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, a comparatively very minor linear activation movement of the activator 6 in the direction P1 is required. Subsequently, the flap 43 by the leaf spring 49 is urged back into the locking position of the former.

The locking element 41 which is present so as to be outwardly pivoted on the lever attachment 40 is again brought to bear on a front edge of the flap 43 when the force accumulator 3 is tensioned. Herein, the locking element 41 yields counter to the spring force of the leg spring 60, such that the locking element 31 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrarian to a connection between activator element of two ejector units on one furniture part.

LIST OF REFERENCE SIGNS

1 Ejector unit
2 Base plate
3 Force accumulator
4 Coupling installation
5 Ejector
6 Activator
7 Locking member
8 Front gap adjustment assembly
9 Cover component
10 Coil spring
11 Coil spring
12 End
13 Fixed mounting
14 Mounting part
15 Set part
16 Operating portion
17 End
18 Motion element
19 Guide contour
20 Linear guide
21 Contact portion
22 Set screw
23 Entrainment element
24 Latch component
**24*a*** Guide pin
25 Guide track
26 Stop element
27 Guide track
29 Stop portion
30 Tension lever
31 Mounting pin
32 Retaining member
33 Spring element
34 Guide lever
35 Connection element
36 Mounting pin
37 Mounting pin
38 Mounting pin
39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer
54 Drawer base
55 Drawer front
56 Side wall
57 Rear drawer wall
58 Device
59 Basic structure side wall
60 Leg spring
61 Synchronizer bar
62 Device
63 Linear guide

The invention claimed is:

1. A device for moving a movable furniture part in an opening direction in relation to a basic furniture structure of an item of furniture, wherein the movable furniture part by way of guide means is capable of being put in the opening direction and into a closing direction that is counter to the opening direction, wherein the device has a force accumulator such that by way of the device which is fitted to the item of furniture the movable furniture part in the case of an opening procedure by action of the force accumulator is capable of being put in an opening position by way of an ejector, wherein a coupling installation which in the case of a charging procedure of the force accumulator is effective between the ejector and the force accumulator is provided, wherein the ejector is designed in such a manner that the latter in the region of the end of the path thereof in the case of the opening procedure couples to the coupling installation, and that for a following closing procedure of the movable furniture part, and a charging procedure of the force accumulator associated therewith, the coupling between the ejector and the force accumulator is effective in a clearance-free manner by way of the coupling installation.

2. The device according to claim 1, wherein a movable control member is provided on the ejector in such a manner that the ejector, for a charging procedure of the force accumulator, is capable of being operationally connected to the coupling installation when the movable furniture part assumes a position which is predefined in relation to the ejector.

3. The device according to claim 2, wherein the movable control member is rotatably disposed on the ejector of the device.

4. The device according to claim 2, wherein the movable control member is guided in such a manner that the ejector of the device is capable of being operationally connected in a clearance-free manner to the coupling installation by a movement of the movable furniture part in the opening direction.

5. The device according to claim 1, wherein the ejector assumes clearance-free coupling to the coupling installation when the ejector in the case of the opening procedure in the closing direction returns to a standby position from the terminal position thereof.

6. The device according to claim 1, wherein the ejector in the standby position is under bias.

7. The device according claim 1, wherein the device comprises an elastic member wherein the elastic member urges the ejector into the standby position thereof.

8. The device according to claim 1, wherein during a movement of the movable furniture part in the closing direction, following completion of the charging procedure of the force accumulator of the device, coupling of the ejector to a coupling member of the coupling installation is released.

9. The device according to claim 1, wherein a coupling member of the coupling installation by way of a first end is movably guided on a gate-type guide.

10. An item of furniture having a device according to claim 1.

* * * * *